United States Patent [19]

Schwaab

[11] Patent Number: 4,679,514

[45] Date of Patent: Jul. 14, 1987

[54] PRESSER FOOT WITH SLIDABLE PLUNGER

[75] Inventor: Konstantin Schwaab, Aichwald, Fed. Rep. of Germany

[73] Assignee: Union Special Corporation, Chicago, Ill.

[21] Appl. No.: 841,124

[22] Filed: Mar. 18, 1986

[30] Foreign Application Priority Data

Apr. 1, 1985 [DE] Fed. Rep. of Germany ..... 3511935

[51] Int. Cl.[4] ..... D05B 29/02

[52] U.S. Cl. ..... 112/235; 24/523; 267/179

[58] Field of Search ..... 112/60, 61, 235, 236, 112/240, 320; 188/65.1, 65.2; 24/523; 144/253 J, 251 A; 139/194; 267/179

[56] References Cited

U.S. PATENT DOCUMENTS

| | | | |
|---|---|---|---|
| 1,487,419 | 3/1924 | Witkus | 112/240 |
| 1,601,238 | 9/1926 | Chalman . | |
| 2,857,870 | 10/1958 | Knierzimen et al. | 112/235 |
| 3,583,344 | 6/1971 | Meier | 112/320 |
| 3,862,751 | 1/1975 | Schwaller | 267/179 X |
| 4,452,158 | 6/1984 | De Palma et al. | 112/235 |

*Primary Examiner*—Werner H. Schroeder
*Assistant Examiner*—Andrew M. Falik
*Attorney, Agent, or Firm*—Powell L. Sprunger

[57] ABSTRACT

A presser foot comprising, a hub having a hollow guide, a plunger having a guide member slidably received in the guide, and a lower portion carrying a sole, with the guide member being biased outwardly in the guide. The presser foot has a guide part secured to the hub guide and having a lower leg directed toward the plunger. The leg and plunger cooperate to prevent rotation of the plunger.

21 Claims, 3 Drawing Figures

PRESSER FOOT WITH SLIDABLE PLUNGER

BACKGROUND OF THE INVENTION

The present invention relates to a presser foot for a sewing machine.

Presser feet for a sewing machine are known. However, prior presser feet have been deficient in various manners. First, the soles and their support plungers of the presser feet have not been sufficiently secured against rotation. The springs of the presser feet have been exposed, they have been relatively hard, and it is difficult to alter their spring force. The materials being sewn can become trapped in the springs, resulting in bending of the springs, thus rendering them unusable. The plunger guide is subjected to relatively high wear, which leads to a rise in the noise level, particularly in the case of high-speed sewing machines.

SUMMARY OF THE INVENTION

A principal feature of the present invention is the provision of an improved presser foot for a sewing machine.

The presser foot of the invention comprises, a hub having a hollow guide, a plunger having a guide member slidably received in the guide, a lower portion pivotally carrying a sole, a ledge on a lower portion of the guide member, and a lower rear flat region beneath the ledge. The presser foot has a helical spring received in the guide member and extending to the hub, such that the spring biases the plunger outwardly in the guide. The presser foot has a guide part secured to the hub guide, with the guide part having a lower resilient plate with a lower leg directed toward the plunger. The leg has a straight edge located adjacent the flat region of the plunger, with the leg located beneath the plunger ledge. The presser foot has a screw extending through the plate of the guide part and bearing upon the hub guide.

A feature of the present invention is that the leg and flat region of the plunger co-operate to prevent rotation of the plunger.

Another feature of the invention is that the leg limits longitudinal movement of the plunger.

Yet another feature of the invention is that the screw may be utilized to adjust position of the leg relative to the plunger.

Still another feature of the invention is that the screw may be utilized to modify play between the guide and plunger.

Further features will become more fully apparent in the following description of the embodiments of this invention and from the appended claims.

DESCRIPTION OF THE PREFERRED EMBODIMENTS

Figure 1:
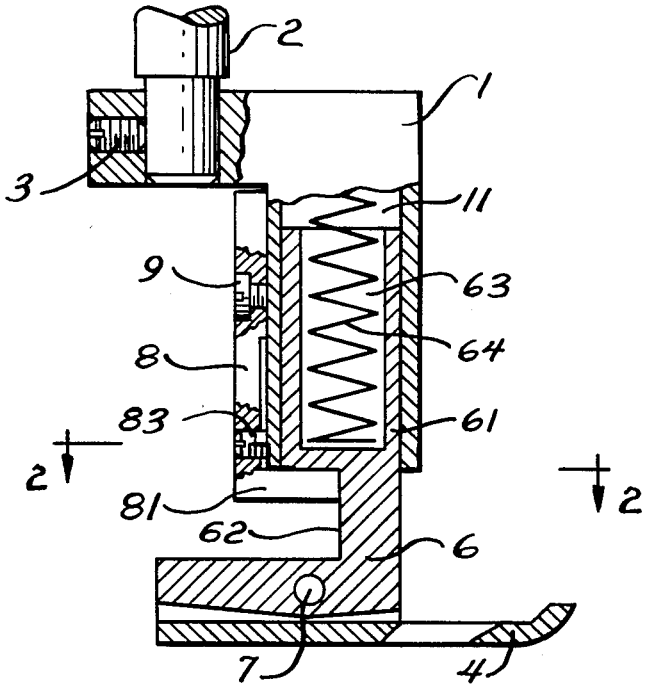
FIG. 1 is an elevational view of a presser foot of the invention taken partly in section.
Figure 2:
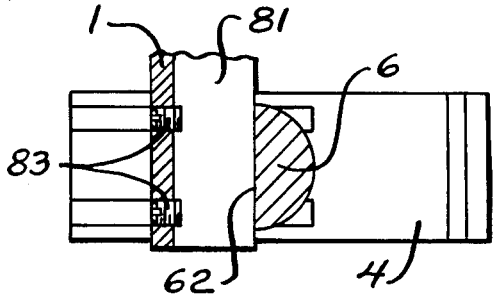
FIG. 2 is a fragmentary sectional view taken substantially as indicated along the line 2—2 of FIG. 1.
Figure 3:
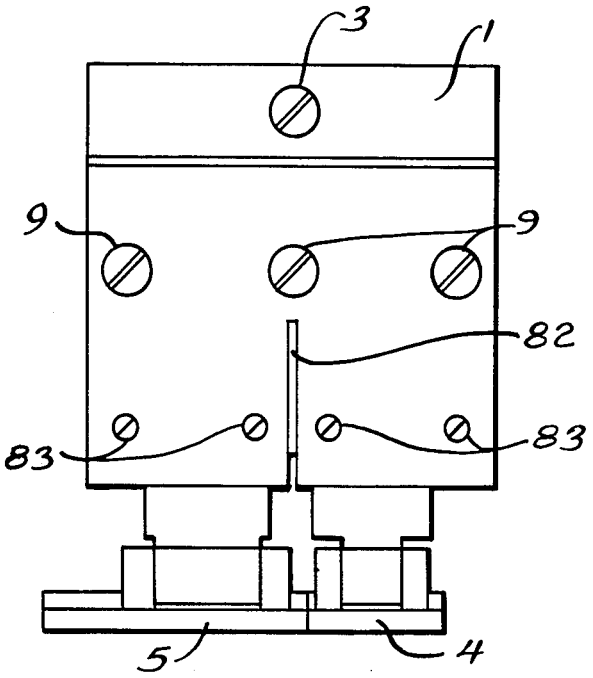
FIG. 3 is a rear elevational view of the presser foot of FIG. 1.

Referring now to FIGS. 1–3, there is shown a presser foot of a sewing machine having a hub 1 secured to a rod 2 by a screw 3. The presser foot has a pair of lower soles 4 and 5 disposed in a side-by-side relationship, with the soles 4 and 5 being pivotally connected to a pair of plungers 6 by a bolt 7.

As shown, the plungers 6 have upper hollow cylindrical guide members 61 slidably received in hollow guides 11 of the hub 1. The plungers 6 have a lower rear flat region 62 beneath the guide members 61, while the upper guide member 61 of the plungers 6 serve as sleeves 63 to receive a helical spring 64. The lower ends of the springs 64 are supported in the sleeves 63, while the upper ends of the springs 64 are received in the hub 1, such that the plungers 6 are biased outwardly by the springs 64 relative to the hub 1.

A rectancular guide part 8 is secured to the guides 11 of the hub 1 by screws 9 through suitable apertures in the guide part 8. The guide part 8 has a pair of lower forwardly directed legs 81 which have an outer straight edge located adjacent the flat regions 62 of the plungers 6. The guide part 8 has a lower slot 82 extending through the guide part 8 and defining a pair of resilient lower plates of the guide part 8 and an associated pair of legs 81 disposed at right angles to the plates. Each of the plates of the guide part 8 has a pair of screws 83 received in suitable apertures, such that the inner end of the screws 83 bear upon the respective guide 11 of hub 1. The screws 83 may be separately adjusted to modify the location of the lower legs 81 relative to the plungers 6. In this manner, the legs 81 may be placed in proper position to prevent rotation of the plungers 6 through cooperation of the legs 81 and the flat regions 62 of the plungers 6. The screws 83 may also be utilized to modify the play between the guides 11 which are flexible and the plungers 6. Also, the legs 81 serve as stops to limit outward movement of the lower end of the guide members. The hub guides 11 completely cover the springs 64 to prevent material from becoming trapped in the springs.

The foregoing detailed description is given for clearness of understanding only, and no unnecessary limitations should be understood therefrom, as modifications will be obvious to those skilled in the art.

I claim:

1. A presser foot, comprising:

a hub having a hollow guide;

a plunger having a guide member slidably received in the guide, said plunger having a lower portion carrying a sole which contacts the material being sewn;

means for biasing the guide member outwardly in the guide;

a guide part secured to the guide of the hub and having a lower leg directed toward the plunger; and means cooperating between the leg and plunger to prevent rotation of the plunger, including means for adjusting the play between the hub guide and guide member.

2. The presser foot of claim 1 wherein the cooperating means comprises a straight outer edge of the leg and an adjacent flat region of the plunger.

3. The presser foot of claim 1 wherein the biasing means comprises a helical spring received in the guide member and extending to the hub.

4. The presser foot of claim 1 including means for adjusting the leg relative to the plunger.

5. The presser foot of claim 4 wherein the guide part has a lower resilient plate, with the leg extending forwardly of the plate, and in which the adjusting means comprises a screw extending through the plate and bearing upon the guide of the hub.

6. The presser foot of claim 1 wherein the guide part has a lower resilient plate, and in which the adjusting means comprises a screw extending through the plate and bearing upon the guide of the hub.

7. The presser foot of claim 1 wherein a portion of the guide member is positioned over the leg, such that the leg serves as an outer stop for the guide member.

8. The presser foot of claim 1 wherein the guide member is fixed to the remaining portion of the plunger.

9. The presser foot of claim 1 wherein the plunger is pivotally connected to the sole.

10. A presser foot, comprising:

a hub having a hollow guide;

a plunger having a guide member fixed to a remaining portion of the plunger and being slidably received in the guide, said plunger having a lower portion carrying a sole which contacts the material being sewn;

means for biasing the guide member outwardly in the guide; and an adjustable guide part having a portion located adjacent the plunger, wherein the guide part has a lower leg which cooperates with the plunger such that it forms a stop to limit longitudinal movement of the plunger, and an outer end of the leg is located adjacent a flat region of the plunger to prevent rotation of the plunger, including a helical spring received in the guide member and extending to the hub.

11. The presser foot of claim 10 wherein the plunger has a flat region adjacent the guide part.

12. The presser foot of claim 10 wherein the guide part is resiliently fastened to the hub, and in which the leg is adjustable towards and away from the plunger by adjusting screws in the guide part.

13. A presser foot, comprising:

a hub having a hollow guide;

a plunger having a guide member slidably received in the guide, a lower portion pivotally carrying a sole, a ledge on a lower portion of the guide member, and a lower rear flat region beneath the ledge;

a helical spring received in the guide member and extending to the hub, such that the spring biases the plunger outwardly in the guide;

a guide part secured to the hub guide, said guide part having a lower resilient plate with a lower leg directed toward the plunger, said leg having a straight edge located adjacent the flat region of the plunger to prevent rotation of the plunger, and with said leg being located beneath the plunger ledge to limit longitudinal movement of the plunger; and a screw extending through the plate of the guide part and bearing upon the hub guide to adjust the leg relative to the plunger and modify play between the guide and plunger.

14. The presser foot of claim 13 wherein the plate has a pair of spaced screws extending through the plate and bearing upon the hub guide.

15. A presser foot, comprising:

a hub having a pair of hollow guides;

a pair of plungers having associated guide members slidably received in the guides, each of the plungers having a lower portion pivotally supporting a sole, a ledge on a lower portion of each guide member, and a lower rear flat region on each of the plungers beneath the associated ledge;

a pair of helical springs received in the guide members and extending to the hub, such that the springs bias the plungers outwardly in the guides;

a guide part secured to the hub guide, said guide part having a lower vertical slot defining a pair of lower resilient plates, said plates each having a lower leg directed toward the plungers, said legs having a straight edge located adjacent the flat regions of the plungers to prevent rotation of the plungers, said legs being located beneath the plunger ledges to limit longitudinal movement of the plungers; and a pair of screws extending through the plates of the guide part and bearing upon the hub guides to adjust the legs relative to the plungers and modify play between the hub guide and plungers.

16. The presser foot of claim 16 wherein each of the plates has a pair of spaced screws extending through the associated plate and bearing upon the hub guides.

17. A presser foot, comprising:

a hug having a hollow guide;

a plunger having a guide member slidably received in the guide, and a lower portion carrying a sole;

means for biasing the guide member outwardly in the guide; and an adjustable guide part having a portion located adjacent the plunger wherein the guide part has a lower leg which cooperates with the plunger such that it forms a stop to limit longitudinal movement of the plunger, and an outer end of the leg is located adjacent a flat region of the plunger to prevent rotation of the plunger, and wherein the guide part is resiliently fastened to the hub, and in which the leg is adjustable towards and away from the plunger by adjusting screws in the guide part.

18. A presser foot, comprising:

a hub having a hollow guide;

a plunger having a guide member slidably received in the guide, said plunger having a lower portion carrying a sole which contacts the material being sewn;

means for biasing the guide member outwardly in the guide;

a guide part secured to the guide of the hub and having a lower leg directed toward the plunger; and means cooperating between the leg and plunger to prevent rotation of the plunger, including means for adjusting the leg relative to the plunger, wherein the guide part has a lower resilient plate, with the leg extending forwardly of the plate, and in which the adjusting means comprises a screw extending through the plate and bearing upon the guide of the hub.

19. A presser foot, comprising:

a hub having a hollow guide;

a plunger having a guide member slidably received in the guide, said plunger having a lower portion carrying a sole which contacts the material being sewn;

means for biasing the guide member outwardly in the guide;

a guide part secured to the guide of the hub and having a lower leg directed toward the plunger; and means cooperating between the leg and plunger to prevent rotation of the plunger, wherein a portion of the guide member is positioned over the leg, such that the leg serves as an outer stop for the guide member.

20. A presser foot, comprising:

a hub having a hollow guide;

a plunger having a guide member slidably received in the guide, said plunger having a lower portion carrying a sole which contacts the material being sewn;

means for biasing the guide member outwardly in the guide;

a guide part secured to the guide of the hub and having a lower leg directed toward the plunger; and means cooperating between the leg and plunger to prevent rotation of the plunger, wherein the guide member is fixed to the remaining portion of the plunger.

21. A presser foot, comprising:

a hub having a hollow guide;

a plunger having a guide member slidably received in the guide, said plunger having a lower portion carrying a sole which contacts the material being sewn;

means for biasing the guide member outwardly in the guide;

a guide part secured to the guide of the hub and having a lower leg directed toward the plunger; and means cooperating between the leg and plunger to prevent rotation of the plunger, wherein the plunger is pivotally connected to the sole.

* * * * *

UNITED STATES PATENT AND TRADEMARK OFFICE

CERTIFICATE OF CORRECTION

PATENT NO. : 4,679,514

DATED : July 14, 1987

INVENTOR(S) : Konstantin Schwaab

It is certified that error appears in the above–identified patent and that said Letters Patent are hereby corrected as shown below:

Title page:

In the assignee, delete "Union Special Corporation, Chicago, Ill.", and insert therefor --Union Special G.m.b.H., Stuttgart, West Germany--.

Signed and Sealed this

Ninth Day of August, 1988

*Attest:*

*Attesting Officer*

DONALD J. QUIGG

*Commissioner of Patents and Trademarks*